United States Patent [19]

Watanabe

[11] 4,367,510

[45] Jan. 4, 1983

[54] REMOTE CONTROL SWITCH DEVICE

[75] Inventor: Katumi Watanabe, Otawara, Japan

[73] Assignee: Fuji Electric Co., Ltd., Kanagawa, Japan

[21] Appl. No.: 263,802

[22] Filed: May 14, 1981

[30] Foreign Application Priority Data

| | | | |
|---|---|---|---|
| May 16, 1980 | [JP] | Japan | 55/64997 |
| Jun. 6, 1980 | [JP] | Japan | 55/76293 |
| May 16, 1980 | [JP] | Japan | 55/67275 |

[51] Int. Cl.[3] ..... H01H 47/22

[52] U.S. Cl. ..... 361/160; 307/114

[58] Field of Search ..... 361/160, 171, 191, 186, 361/208, 210; 307/41, 113, 114, 115, 140, 141.4; 340/825.57, 825.98

[56] References Cited

U.S. PATENT DOCUMENTS

| | | | |
|---|---|---|---|
| 2,892,132 | 6/1959 | Mallory | 361/191 |
| 3,026,448 | 3/1962 | Brown | 361/160 X |
| 3,794,888 | 2/1974 | Hisano | 307/114 X |

*Primary Examiner*—Harry E. Moose, Jr.

*Attorney, Agent, or Firm*—Sughrue, Mion, Zinn, Macpeak & Seas

[57] ABSTRACT

A remote control switch device having a main switch connected between a power supply and a load circuit, a control circuit having auxiliary contacts interlocking with the main switch, a first diode connected in series with the auxiliary contact, a second diode connected in a direction opposite the first diode coupled across the series circuit, an electromagnetic coil connected in series with the second diode for opening or closing the main switch, an isolating transformer connected to the power supply, and an operation indicating circuit having a push-button switch connected to the secondary side of the transformer and remotely connected to the control circuit. The remote control switch device employs as the main switch a keep relay which is mechanically retained at the open or closed position and controlled by the electromagnetic coil through simple signal communication lines.

9 Claims, 11 Drawing Figures

REMOTE CONTROL SWITCH DEVICE

BACKGROUND OF THE INVENTION

The present invention relates to a remote control switch device which remotely operates a power load switch device by using a low voltage signal communication line and displays the operational position of the power load switch device at the side from which it is operated.

For remotely controlling a power load circuit such as an illumination lamp, it is desired that the operating circuit therefor be safe, easily operable and that no current constantly flow therethrough. For this purpose, in remotely controlling a simple load which may be operated merely by opening or closing a main switch such as a lamp load, there has recently been used as a main switch a mechanical holding type relay, which is hereinafter termed a "keep relay", which alternatively repeats opening and closing operations simply by momentarily passing an electric current through an electromagnetic coil thereof with the relay being consequently retained mechanically at the opened or closed position thereby set.

When such a keep relay is employed, the operating circuit may safely be insulated through an isolating transformer from a main circuit. Further, a long wire to a remote circuit may be provided as a small and lightly-insulated signal communication line because it need carry only a low level current. Since with this keep relay, however, a main switch is opened or closed merely by momentarily passing an electric current through a single electromagnetic coil, it cannot be set to a desired state from the position from which it is operated unless it is known whether or not the switch is presently opened or closed at the position from which the switch is operated. Therefore, an indicator lamp is provided at the operating position to indicate the opened or closed state of the main switch. Remote control switch devices of this type recently have employed an energy-saving type of indicator lamp, but the circuit therefor is complicated. Moreover, most remote control switch devices require more than three wires to connect it to the operating circuit.

FIG. 1 is a wiring diagram showing an example of a conventional remote control switch device in which the aforementioned disadvantages have been eliminated. In FIG. 1, a main switch 3 coupled between an a-c power supply 1 and a load 2 is a contact of a keep relay. The keep relay also includes a switching type auxiliary contact 4 interlocking with the main switch 3 and an electromagnetic coil 5. Two diodes 6*a* and 6*b*, connected in opposite directions, have first terminals connected to one end of the coil 5 of the keep relay in a control circuit 7 with the second terminals thereof connected through the auxiliary contact 4 so as to switch the connections of the diodes. An operation indicating circuit 8 includes a parallel connection of a series circuit of an indicator lamp 9 and a diode 10 and of a series circuit of a change-over switch 11 and two diodes 12*a* and 12*b* with first terminals connected in opposite directions to the switch 11 and with second terminals connected to signal communication lines 13. An isolating transformer 14 has an input winding connected to the power supply 1, one terminal of a secondary winding connected directly to the electromagnetic coil 5 and the other terminal of the secondary winding connected via the signal communication lines 13 through the operation indicating circuit 8 to the armature of the auxiliary contact 4.

When the switch 11 in the operation indicating circuit 8 is switched to connect the diode 12*a*, and electric current flows in a circuit composed of the diode 12*a*, the switch 11, the transformer 14, the electromagnetic coil 5, the diode 6*a*, and the auxiliary contact 4 (as designated by solid-line arrows) to thereby energize the electromagnetic coil and to thus operate the keep relay. Thereby, the main switch 3 is closed, and the load 2 is connected to the power supply 1. When the auxiliary contact 4 is switched to connect the diode 6*b*, the electric current flowing in the circuit (as designated by solid-line arrows) is interrupted and an electric current flows in a circuit composed of the diode 6*b*, the electromagnetic coil 5, the transformer 14, the indicator lamp 9, the diode 10, and the auxiliary contact 4 (as designated by broken-line arrows) to thereby turn on the lamp 9 to indicate that the load 2 is connected to the power supply 1. Then, the switch 11 is returned to its intermediate position. In this state, an electric current still flows through the electromagnetic coil 5 since the indicator lamp 9 is connected in the circuit. However, this current is very low and can thus be ignored so far as the coil 5 is concerned.

When the switch 11 in the operation indicating circuit 8 is switched to connect the diode 12*b*, an electric current flows in a circuit (as designated by broken-line arrows) except for the indicator lamp 9 and the diode 10 to thereby again energize the electromagnetic coil 5 so as to operate the keep relay. This opens the main switch 3 and the current flow to the load 2 is interrupted. Inasmuch as the auxiliary contact 4 is simultaneously switched to connect the diode 6*a*, even if the switch 11 is returned to the intermediate no-connection position, no electric current will flow through the indicator lamp 9. That is, the indicator lamp 9 will not then turn on, thus indicating the disconnection of the load 2 from the power supply 1.

Although the conventional remote control switch device can thus be operated merely by momentarily passing an electric current through an isolating transformer using two signal communication lines, a change-over switch must also be provided which is complicated in operation. Further, when the indication lamp is turned on, a current flows through the electromagnetic coil of the keep relay. In case that the number of the indicator lamps is small, the magnitude of this current flowing through the coil will be acceptably small and can be ignored. However, in case that a large number of operating circuits is required for operating the main switches from the respective operating circuits, a corresponding larger number of indicator lamps must be employed and a larger magnitude of current will flow in the coil. The increased magnitude of the current may eventually cause an erroneous operation of the keep relay.

FIG. 2 shows another example of a conventional remote control switch device and employing a keep relay. In FIG. 2, a main switch 23 inserted between an a-c power supply 21 and a load 22 includes a main contact 24, a keep relay 27 including a switching type auxiliary contact 25 interlocking with the main contact 24 and operating simultaneously upon operation of the main contact 24 and an electromagnetic coil 26, and diodes 28*a* and 28*b* connected in opposite directions and coupled to be switched by the auxiliary contact 25 connected in series with the electromagnetic coil 26. The input or primary winding of an isolating trnsformer 29 is connected to the power supply 21 and the secondary winding thereof is connected as a control power supply to a main switch 33 through signal communication lines 35 through a remotely-located operation indicating circuit 30. The operation indicating circuit 30 includes a keep relay 38 including a switching contact 37 and an electromagnetic coil 36 for actuating the contact 37, a switching type push-button switch 33, diodes 34*a* and 34*b* connected in opposite directions and switched in connection by the switching contact 37, and an indicator lamp 31. The connection of the diodes 34*a* and 34*b* to the electromagnetic coil 36 is switched by the push-button switch 33. The keep relay 38 used in the operation indicating circuit 30 may be of a small capacity type and need be capable only of switching the contact 37. The impedance of the coil 36 is thus very high compared with that of the coil 26.

When the push-button in the operation indicating circuit 30 is depressed, the switch 33 is switched from the position shown in FIG. 2 to connect with the armature of the switching contact 37, and an electric current flows in a circuit composed of the push-button switch 33, the transformer 29, the coil 26, the diode 28*a*, the auxiliary contact 25, the diode 34*a*, and the switching contact 37 (as designated by solid-line arrows) thereby energizing the electromagnetic coil 26. Thus, the keep relay 27 is operated to close the main contact 24 and the load 22 is connected to the power supply 21. The auxiliary contact 25 is simultaneously switched at that time, and current flowing along the path designated by soid-line arrows is interrupted. Then, a current flows in a circuit composed of the auxiliary contact 25, the diode 28*b*, the coil 26, the transformer 39, the indicator lamp 31, and the diode 34*b* (as designated by broken-line arrows) thereby turning on the lamp 31 to indicate that the load 22 is connected to the power supply 21. Since the impedance of the indicator lamp 31 is very high as compared with that of the electromagnetic coil 26, the keep relay 27 will not be operated by the current then flowing therethrough. When the push-button is released, the switch 33 is returned to the side of the electromagnetic coil 36 to connect the coil 36. Then, a current flows in a circuit composed of the coil 36, the auxiliary contact 25, the diode 28*b*, the coil 26, and the transformer 29 (as designated by broken-line arrows) to thereby energize the coil 36. Thus, the keep relay 38 is operated to switch the contact 37.

The electromagnetic coils 36 and 26 are connected in series with each other at this time. However, since the impedance of the electromagnetic coil 36 is very high as compared with that of the electromagnetic coil 26 even if the coil 36 is always energized, the coil 36 will not burn out and the keep relay 27 will not operate.

When the push-button in the operation indicating circuit 30 is again depressed, the respective switches are switched to positions opposite to those shown in FIG. 2 and current accordingly flows in a circuit composed of the push-button switch 33, the switching contact 37, the diode 34*b*, the auxiliary contact 25, the diode 38*b*, the coil 25, and the transformer 29 (as designated by broke-line arrows) to thereby energize the coil 26. Accordingly, the keep relay 27 is operated opening the main contact 24 and interrupting the load 22 from the power supply 21. Since the auxiliary contact 25 is simultaneously switched, the current flowing in the direction designated by the broken-line arrows is interrupted and the indicatior lamp 31 is consequently deenergized. When the push-button is released, the switch 33 is returned to the original state as shown in FIG. 2, and current accordingly flows in a circuit composed of the push-button switch 33, the transformer 29, the coil 26, the diode 28*a*, the auxiliary contact 25, and the coil 36 (as designated by solid-line arrows). Thus, the keep relay 38 is operated to switch the contact 37, and all the contacts are switched to the positions shown in FIG. 2.

As heretofore described. the conventional remote control switch device can operate with two signal communication lines using an isolating transformer. However, the switches in the operating circuit employ relatively complicated and expensive keep relays. There has been also proposed a remote control switch which controls a main circuit using a simple push-button switch without a keep relay. This switch is nonetheless disadvantageous in that it incorporates an operation indicating circuit used exclusively for the push-button and which cannot therefore be conveniently interchanged with or commonly used as an operation indicating circuit with a keep relay of the type previously described.

SUMMARY OF THE INVENTION

Accordingly, a principal object of the present invention is to provide a remote control switch device which eliminates the aforementioned drawbacks and which employs only two signal communication lines and which also uses a simple push-button switch and an indicator or display circuit at the operating position.

In order to accomplish the above and other objects, there is provided, according to one aspect of the invention, a remote control switch device which includes a main switch connected in a closed loop circuit with an a-c power supply and a load opened or closed by an electromagnetic coil and which is mechanically retained at an open or closed position each time the coil is energized, a control circuit having a series circuit of auxiliary contacts mechanically interlocking with the main swtich and a first diode connected to the auxiliary contacts, a second diode connected in the direction opposite to the first diode in the series circuit and an electromagnetic coil connected in series with a parallel circuit composed of the series circuit and the second diode, an isolating transformer having a primary winding connected to the power supply, and an indicator or display circuit having a series circuit of a push-button switch connected to the secondary side of the isolating transformer and connected in series with the control circuit and an indicator lamp and a third diode connected in parallel with the push-button switch, wherein the third diode in the display circuit and the first diode in the control circuit are so connected as to pass an electric current of the same direction.

The foregoing objects and other objects as well as the characteristic features of the invention will become more apparent and more readily understandable from the following description and the appended claims when read in conjunction with the accompanying drawings.

DESCRIPTION OF THE PREFERRED EMBODIMENTS

Figure 3:
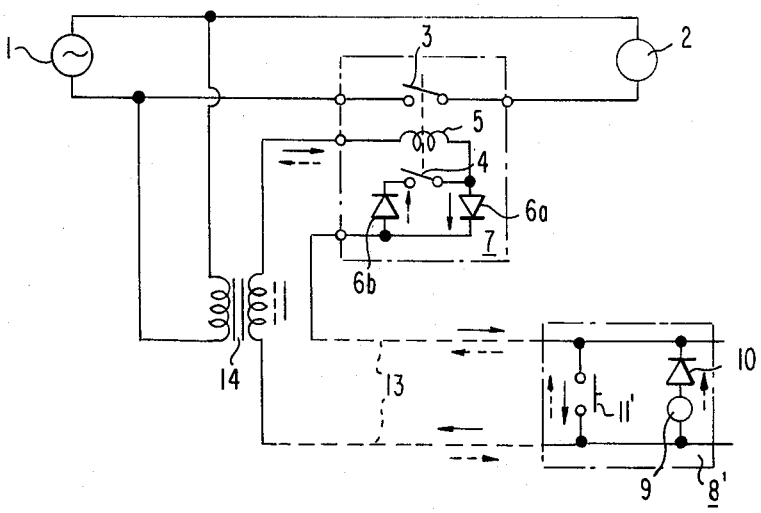
FIGS. 3 through 6 are schematic digrams showing first through fourth embodiments of a remote control switch device constructed according to the invention.

Reference is now made to the drawings, particularly to FIG. 3 showing a first preferred embodiment of a remote control switch device constructed according to the invention, wherein like reference numerals designate the same parts in the other figures. In FIG. 3, a main switch 3 connected between an a-c power supply 1 and a load 2 forms a keep relay which includes auxiliary contacts 4 mechanically interlocking with the main switch 3 and an electromagnetic coil 5. A control circuit 7 is formed by series circuit of auxiliary contacts 4 and a first diode 6*b* connected to the auxiliary contacts 4, a second diode 6*a* connected across the series circuit in the direction opposite to the first diode in the series circuit, and an electromagnetic coil 5 connected in series with the parallel circuit of the series circuit and the second diode 6*a*.

A self-resetting type push-button switch 11′ is provided for operating the control circuit 7, the contacts of which are closed when the push-button is depressed and open when the push-button is released. An indicator or display circuit 8′ is formed by a series circuit of the push-button switch 11′ and an indicator lamp 9 with a diode 10 being connected in parallel with the push-button switch 11′. The primary winding of an isolating transformer 14 is connected to the power supply 1, one terminal of the secondary winding thereof is connected directly to one end of the control circuit 7, and the other terminal of the secondary widning is coupled through the signal communication lines 13 through the push-button switch 11 and the display circuit 8′ to the other end of the control circuit 7. It is noted that the diode 10 in the display circuit 8′ should be so connected with respect to the diode 6*b* connected in series with the auxiliary contacts 4 in the control circuit 7 that a current can flow in the circuit formed thereby. It is also noted that two or more push-button switches 11′ and two or more display circuits 8′ may be provided by extending the lines connected therebetween. Also, the push-button switch 11 and the display circuit 8′ may be installed independently at remote positions from each other. Moreover, the indicator lamp 9 and the diode 10 may together be replaced by a light-emitting diode.

When the push-button switch 11′ is depressed, a current flows in a circuit composed of the push-button switch 11′, the transformer 14, the electromagnetic coil 5, and the diode 6*a* (as designated by solid-line arrows) to thereby energize the electromagnetic coil 5. Thus, the keep relay is operated to close the main switch 3 and the load 2 is connected to the power supply 1. Then, the auxiliary contacts 4 are closed and a current then flows in a circuit composed of the auxiliary contact 4, the electromagnetic coil 5, the transformer 14, the push-button switch 11′, and the diode 6*b* (as designated by broken-line arrows). Therefore, an a-c current flows through the electromagnetic coil 5, the transformer 14 and the push-button switch 11′. Since the only effect on the current flowing through the electromagnetic coil 5 by the closure of the auxiliary contacts 4 is an increase in the magnitude of the current, there is no further change in the state of the keep relay. When the push-button switch 11′ is released in this state, the current flowing in the circuit as designated by the solid-line arrows is interrupted and a current flowing in the circuit as designated by broken-line arrows then flows through the display circuit 8′ to thereby turn on the indicator lamp 9 which indicates the closure of the main switch 3. The current flowing in the circuit as designated by the broken-line arrows also flows continuously through the electromagnetic coil 5. However, since the indicator lamp 9 is connected in this circuit, the current is of a small magnitude and can be ignored so far as the operation of the keep relay is concerned.

When the push-button switch 11′ is again depressed, a current will flow in a circuit designated by solid-line arrows. The coil 5 is thus again energized and the keep relay is accordingly operated to open the main switch 3 so that the load 2 is disconnected from the power supply 1. Then, the auxiliary contacts 4 are opened, and an electric current flowing in the circuit designated by the broken-line arrows is thus interrupted. Consequently, when the push-button switch 11′ is released, the indicator lamp 9 dows not turn on and accordingly indicates that the main switch 3 is opened. The remote control switch device repeats the aforementioned operations every time the push-button switch is depressed, closing or opening the main switch. The indicator lamp is turned on when the main switch is closed and turned off when the main switch is opened.

In the embodiment, the remote control switch device employs as a main switch a keep relay which is mechanically retained at the open or closed position every time that it is switched by the electromagnetic coil, the current flow in the electromagnetic coil is controlled by a push-button switch with a low voltage produced at the secondary winding of the isolating transformer connected to the power supply, and the opening or closing operation of the auxiliary contacts interlocked with the main switch is sensed with a diode connected in the display circuit using the same current as flows in the coil for displaying the open or closed state of the main switch. Accordingly, two simple signal communication lines can be employed. Moreover, since no diode is used in the push-button switch, in the remote control switch device of this embodiment the number of parts is reduced, the circuit can be easily constructed, and the operation thereof is simple.

Figure 4:
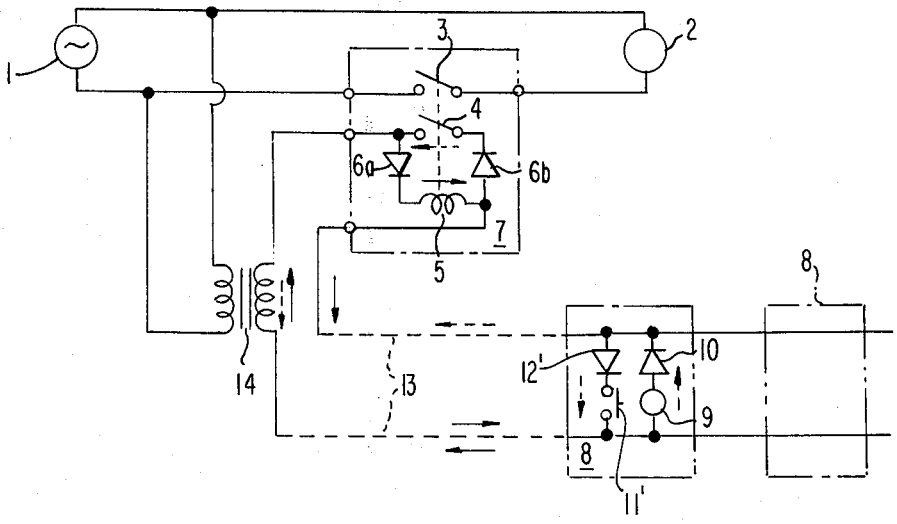

Another embodiment of a remote control switch device constructed according to the invention will now be described in detail with reference to FIG. 4 wherein like reference numerals designate the same component parts as those shown in FIG. 3. The embodiment shown in FIG. 4 is substantially the same as that shown in FIG. 3 but differs from that shown in FIG. 3 in that a diode 12′ is connected in series with the push-button switch 11′ in the operation indicating circuit 8′ and the diode 12′ is connected in a direction opposite to the diode 10.

When the push-button switch 11′ is depressed, a current flows in a circuit composed of the push-button switch 11', the transformer 14, the diode 6a, the electromagnetic coil 5, the diode 12' (as designated by solid-line arrows) to thereby energize the electromagnetic coil 5. Thus, the keep relay is operated to close the main switch 3 and the load 2 is connected to the power supply 1. Then, the auxiliary contacts 4 are closed and a current will flow in a circuit composed of the transformer 14, the indicator lamp 9, the diode 10, the diode 6b, and the auxiliary contacts 4 (as designated by broken-line arrows) to thereby turn on the indicator lamp 9. Even if the push-button switch 11' is released at this time, this state is retained.

When the push-button switch 11' is then depressed, a current will again flow in a circuit designated by solid-line arrows to thereby again energize the electromagnetic coil 5. Thus, the keep relay is operated and the main switch 3 is opened this time so that the load 2 is disconnected from the power supply 1. The auxiliary contacts 4 are opened at this time, a current flowing in the circuit designated by the broken-line arrows is interrupted, and the indicator lamp 9 is resultantly turned off. The remote control switch device of this embodiment repeats the aforementioned operations every time the push-button switch is depressed closing or opening the main switch. In this embodiment, the indicator lamp indicates operations as required, but current does not flow through the electromagnetic coil of the keep relay.

Figure 5:
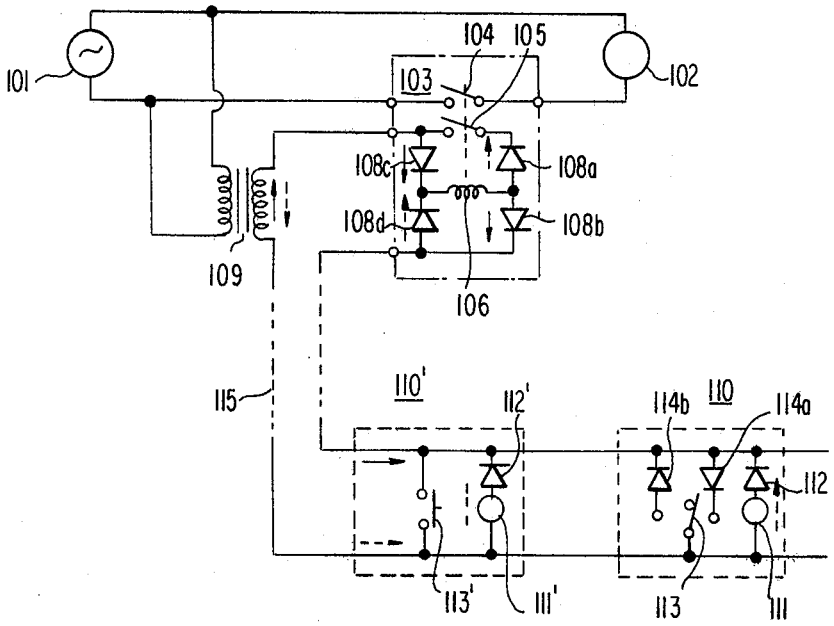

A further embodiment of the remote control switch device constructed according to the invention will now be described in detail with reference to FIG. 5. In FIG. 5, a main switch 103 connected between an a-c power supply 101 and a load 102 is implemented with a keep relay 105 including main contacts 104, auxiliary contacts 105 operating simultaneously with the main contacts 104 and an electromagnetic coil 106, and a single-phase bridge circuit including four diodes 108a, 108b, 108c, 108d with the electromagnetic coil 106 being connected to the output side of the bridge circuit and the auxiliary contacts 105 being connected in series with the diode 108a. The primary winding of an isolating transformer 109 is connected to the power supply 101. One terminal of the secondary winding is connected directly to the main switch 103 while the other is connected through an operation indicating circuit 110' to the main switch 103 to thus operate as the power supply of the single-phase bridge circuit. The operation indicating circuit 110' includes a series circuit of a signal lamp 111' and a diode 112' and a push-button switch 113' connected in parallel with the series circuit. The operation indicating circuit 110' is externally connected through signal communication lines 115. Further, the operation indicating circuit 110' may also be connected in parallel with another operation indicating circuit 110 which is composed of a series circuit of an indicator lamp 111 and a diode 112, a three-contact change-over switch 113 and two diodes 114a and 114b connected in opposite directions to pole contacts of the switch 113. The switch 113 is thereby capable of switching the connection of the two diodes 114a and 114b between the signal communication lines 115.

When the push-button switch 113' is depressed in the circuit shown in FIG. 5, an electric current will flow in a circuit composed of the push-button switch 113', the transformer 109, the diode 108c, the electromagnetic coil 106, and the diode 108b (as designated by solid-line arrows) to thereby energize the electromagnetic coil 106. Thus, the keep relay 107 is operated, the main contacts 104 are closed, and the load 102 is consequently connected to the power supply 101. Simultaneously, the auxiliary contacts 105 are closed and a current flows in a circuit composed of the auxiliary contacts 105, the transformer 109, the indicator lamp 111' (or the push-button switch 113'), the diode 108d, the electromagnetic coil 106, and the diode 108a (as designated by broken-line arrows). Since the effect on the electromagnetic coil 106 due to the closure of the auxiliary contacts is only a slight increase in the current flowing therethrough, the keep relay 107 retains its state. When the push-button switch 113' is then released, the current flowing in the circuit (as designated by the solid line arrows) is interrupted, and the indicator lamp 111' is thus turned on to indicate that the load is connected to the power supply. Since the indicator lamp 111' is connected in this circuit, the current flowing through the coil is small and can be accordingly ignored so far as the operation of the electromagnetic coil 106 is concerned. The state of the keep relay is therefore retained.

When the push-button switch is again depressed, a current will again flow, in the manner described above, in a circuit designated by the solid-line arrows. The electromagnetic coil 106 is thus again energized and the keep relay 107 is consequently operated, this time to open the main contacts 104 and to disconnect the load 102 from the power supply 1. Since the auxiliary contacts 105 are simultaneously opened, even if the push-button switch 113' is released, the indicator lamp does not, as described heretofore, turn on. That is, the circuit is returned to its original state as shown in FIG. 5.

It is noted that the foregoing description is directed to a circuit in which the auxiliary contacts 105 are connected in series with the diode 108a, but the same operational effect is achieved even if the auxiliary contacts 105 are connected in series with the diode 108d because a current will constantly flow in a circuit through the diode 108a and the diode 108d. It is also noted that, if the auxiliary contacts 105 are connected in series with the diode 108b or 108c, a current will flow in the operation indicating circuit in the opposite direction to the case where the auxiliary contacts 105 are connected in series with the diodes 108a or 108d. The diode 112' should, in that case, be connected in the opposite direction so as to obtain the same operation as before.

When the three-contact change-over switch 113 in the operation indicating circuit 110 connected in parallel with the operation indication circuit 110' is switched to connect the diode 114a in FIG. 5, a current will flow in a circuit designated by solid-lines arrows. The electromagnetic coil 106 is then energized, the keep relay 107 is accordingly operated, the main contacts 104 are thus closed, and the load 102 is connected to the power supply 101. Then, the auxiliary contacts 105 are closed, an electric current as designated by broken-line arrows flows, and the indicator lamp 111 is accordingly turned on. The indicator lamp 111' is simultaneously turned on at this time. Further, a current flowing in the circuit is designated by the broken-line arrows is added to the current flowing in the circuit designated by the solid-line arrows through the electromagnetic coil 106 at this time. However, since both the currents flow in the same direction through the electromagnetic coil 106, the keep relay 107 is retained and the main contacts 104 accordingly remain closed. Even if the three-contact change-over switch 113 is opened, only the current flowing in the circuit as designated by the solid lines with arrows is interrupted, the main contacts 104 remain closed, and only the indicator lamp 111 remains lit. The current may be ignored so far as the operation of the electromagnetic coil 106 is concerned.

When the three-contact change-over switch 113 is then switched to connect the diode 114*b*, a current will flow in the circuit as designated by broken-line arrows as already described, the electromagnetic coil 106 is accordingly energized, the keep relay 107 is resultantly operated, the main contacts 104 are therefore opened, and the load 102 is consequently disconnected from the power supply 102. The auxiliary contacts 105 are simultaneously opened at this time and the current flowing in the circuit as designated by the broken-line arrows is accordingly interrupted. The indicator lamp 111 is turned off when the three-contact change-over switch 113 is switched to connect the diode 114*b* to thereby indicate that the load 102 is disconnected from the power supply 101. It is noted that if the auxiliary contacts 105 are connected in series with the diode 108*d* at the other side of the single-phase bridge circuit, it is not necessary to change the connecting direction of the diode 112 in the operation indicating circuit 110 similarly to the operation indicating circuit 110'. However, if the auxiliary contacts 105 are connected in series with the diode 108*b* or 108*c*, not only the direction of the diode 112 but also the directions of the diodes 114*a*, 114*b* should be made opposite to those shown in FIG. 5.

As heretofore described, this embodiment of a remote control switch device of the invention employs as the main switch a keep relay and as the excitation power supply of the keep relay a single-phase rectification bridge circuit having four diodes for rectifying the low secondary voltage of the isolating transformer applied from the main circuit which passes an electric current in the circuit in only one direction. Accordingly, this remote control switch device of this embodiment operates merely by depressing the push-button and employs ordinary signal communication lines. In addition, this embodiment can also employ an operation indicating circuit as exemplified by the circuit 110. Both types of circuits may also be simultaneously employed and disposed at different positions thereby providing a remarkably excellent remote control operation indicating type switch device.

Still another embodiment of the remote control switch device constructed according to the invention will now be described in detail with reference to FIG. 6, a main switch 203 connected between an a-c power supply 210 and a load 202 includes a keep relay 207 including main contacts 204, auxiliary contacts 205 operating simultaneously with the main contacts 204, and an electromagnetic coil 206, and a single-phase rectifying circuit including four diodes 208*a*, 208*b*, 208*c* and 208*d* with a capacitor 219 connected in parallel with the electromagnetic coil 206. The electromagnetic coil 206 is connected to the output side of the bridge circuit constituted by the four diodes 208*a*, 208*b*, 208*c* and 208*d*. The auxiliary contacts 205 are connected so as to switch between the diodes 208*a* and 208*c*, that is, to alternatively connect one of the two diodes 208*a* and 208*c* to the control power supplied from an isolating transformer 209. The primary winding of the isolating transformer 209 is connected to the power supply 201, one terminal of the secondary winding through the signal communication lines 215 through a remotely installed operation indicating circuit 210' and a second terminal of the secondary winding is coupled directly to the main switch 203. The operation indicating circuit 210' has a series circuit of an indicator lamp 211' and a diode 212, and a push-button switch 213' connected in parallel with the series circuit. Reference numeral 210 designates an operation indicating circuit which employs a keep relay. This operation indicating circuit 210 includes a keep relay 218 having a switching contact 217 and an electromagnetic coil 216 for actuating the contact 217, a push-button switch 213, oppositely-connected diodes 214*a* and 214*b* coupled to be switched in connection by the switching contact 217, and an indicator lamp 211 as heretofore described with reference to FIG. 2. That is, the circuit shown in FIG. 6 incorporates two operation indicating circuits 210, 210'.

When the push-button of the operation indicating circuit 210' is depressed, the switch 213' is closed and a current resultantly flows in a circuit composed of the push-button switch 213', the transformer 209, the auxiliary contacts 205, the diode 208*c*, the coil 206, and the diode 208*b* (as designated by solid-line arrows), and the electromagnetic coil 206 is accordingly energized. Thus, the keep relay 207 is operated, the main contacts 204 are closed, and the load 202 is consequently connected to the power supply 201. Since the auxiliary contacts 205 are simultaneously closed at this time, the current flowing in the circuit is designated by the solid-line arrows is interrupted. However, charge stored in the capacitor 219 gives rise to a current flowing through the electromagnetic coil 206. This current flows through the electromagnetic coil 206 in the same direction as the previously-present current. This current flows in a circuit composed of the auxiliary contact 205, the transformer 209, the push-button switch 213', the diode 208*d*, the coil 206, and the diode 208*a* (as designated by broken-line arrows. The capacitor 219 smooths the half-wave pulsating current rectified by the diode 208*a* and 208*d*, and causes a current to continuously flow through the electromagnetic coil 206 while the current flowing in the circuit along the path designated by the solid-line arrows upon depression of the push-button as heretofore described is switched to the electric current flowing in the circuit as designated by the broken-line arrows. Accordingly, the keep relay 207 retains the state it was set to by depression of the push-button. Since the switch 213' is opened when the push-button is depressed, the current flowing in the circuit is designated by the broken-line arrows is switched to flow in the circuit of the indicator lamp 211' and the diode 212. Thus, the indicator lamp 211' is turned on to indicate that the load 202 is connected to the power supply 201. Simultaneously, the indicator lamp 211 in the operation indicating circuit 210 is also turned on. Since the impedances of the indicator lamps 211 and 211' are much higher than that of the electromagnetic coil 206, the keep relay 207 is not operated by the current which causes the indicator lamps to glow.

When the push-button is again depressed, a current will flow again in the circuit composed of the push-button switch 213', the diode 208*d*, the coil 206, the diode 208*a*, the auxiliary contacts 205, and the transformer 209 (as designated by broken-line arrows) and the electromagnetic coil 206 is accordingly energized. Thus, the keep relay 207 is operated, the main contacts 204 are resultantly opened, and the load 202 is consequently disconnected from the power supply 201. Since the auxiliary contacts 205 are simultaneously switched to the other position, the current flowing in the circuit as designated by the broken-line arrows is switched to the current flowing in the circuit as designated by the solid-line arrows. Thus, the indicator lamps 211 and 211', which are turned off when the push-button switch is closed, will not turn on even if the switch is opened. When the auxiliary contacts 205 switch the current flowing in the circuit as designated by the broken-line arrows to the current flowing in the circuit as designated by the solid-line arrows, the current in the circuit is momentarily interrupted. However, since the charge stored by the capacitor 219 is discharged at this time causing a current to flow through the circuit in the same direction as before, the keep relay 207 is not again operated. Accordingly, the remote control switch device is operated with the simple push-button switch 213' connected in parallel with the series circuit of the diode 212 and the indicator lamp 211' to thereby correctly indicate the result of the operation.

Figure 6:
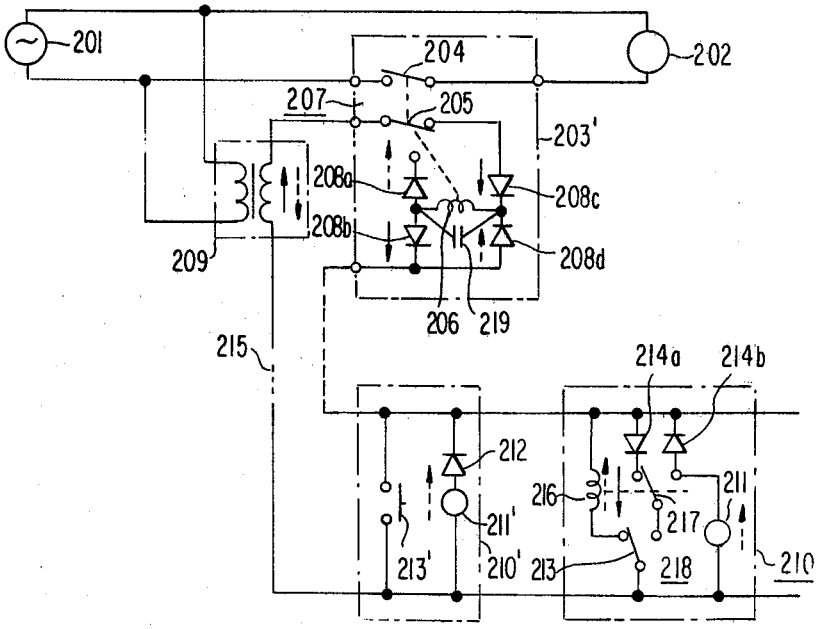

The remote control switch device of the invention will now be described with reference to the case of the remote control switch as shown in FIG. 6.

Figure 1:
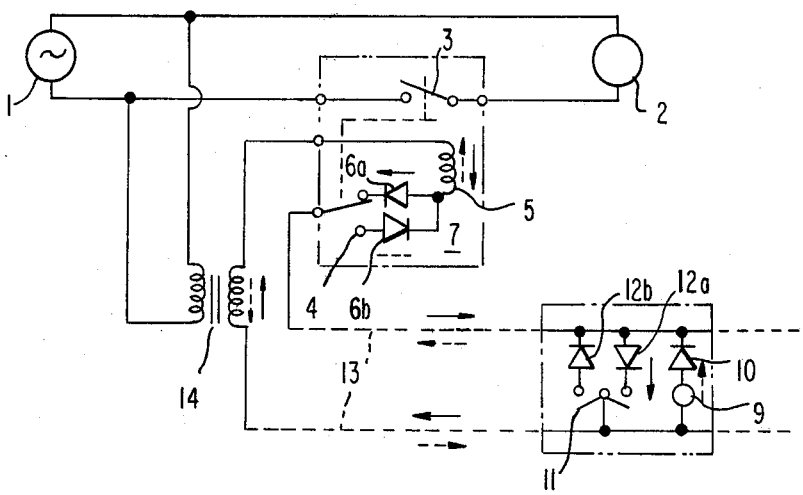
FIG. 1 PRIOR ART
FIG. 1 is a schematic diagram showing a first example of a conventional remote control switch.
Figure 2:
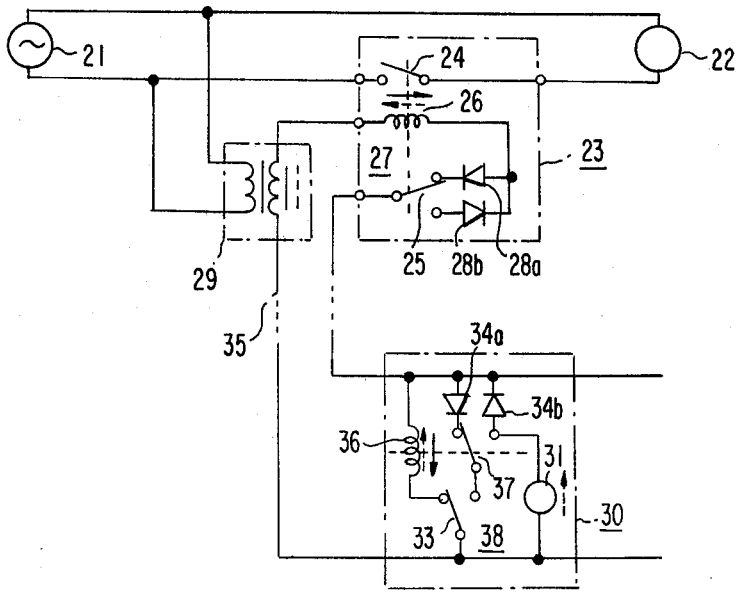
FIG. 2 PRIOR ART
FIG. 2 is a schematic diagram showing a second example of a conventional remote control switch.

When the push-button in the operation indicating circuit 210 is depressed in the state of the circuit shown in FIG. 6, the switch 213 is switched to connect the switching contact 217, and current will accordingly flow in a circuit composed of the push-button switch 213, the transformer 209, the auxiliary contacts 205, the diode 208*c*, the coil 206, the diode 208*b*, the diode 214*a*, and the switching circuit 217 (as designated by solid-line arrows) and the electromagnetic coil 206 is resultantly energized. Thus, the keep relay 207 is operated, the main contacts 204 are closed, and the load 202 is consequently connected to the power supply 201. At this time, the auxiliary contacts 205 are simultaneously switched to the opposite side, the current flowing in the circuit as designated by the solid-line arrows is interrupted, and current will newly flow in a circuit composed of the auxiliary contacts 205, the transformer 209, the indicator lamp 211, the diode 214*b*, the diode 208*d*, the coil 206, and the diode 208*a* (as designated by broken lines with arrows). The indicator lamp 211 is thus turned on indicating that the load 202 is connected to the power supply 201. Of course, the indicator lamp 211' is turned on at the same time. Since the impedances of the indicator lamps 211 and 211' are much higher than that of the electromagnetic coil 206, the keep relay 207 is not operated. When the push-button is released, the switch 213 is returned to the state as shown in FIG. 2 and current will accordingly flow in a circuit composed of the push-button switch 213, the coil 216, the diode 208*d*, the coil 206, the diode 208*a*, the auxiliary contacts 205, and the transformer 209 (as designated by broken-line arrows) and the electromagnetic coil 216 is thus energized. Thus, the keep relay 218 is operated and the switching contacts 217 are switched to the opposite side. Thereafter, the electromagnetic coils 206 and 216 continue to be energized. However, since the impedance of the electromagnetic coil 216 is much higher than that of the coil 206, the coil 216 will not burn out and the keep relay 207 is not operated.

Figure 7:
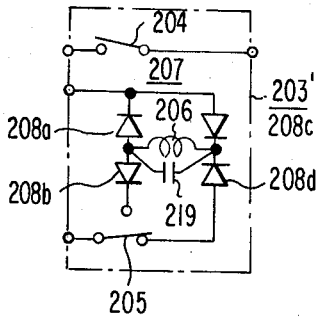
FIG. 7 is a wiring diagram of a modified main switch in the fourth embodiment shown in FIG. 6.

When the push-button is again depressed, a current will flow in a circuit composed of the push-button switch 213, the switching contacts 217, the diode 214*b*, the diode 208*d*, the coil 206, the diode 208*a*, the auxiliary contacts 205, the transformer 209 (as designated by broken-line arrows) and the electromagnetic coil 206 is thus energized. Accordingly, the keep relay 207 is operated, the main contacts 204 are opened, and the load 202 is consequently disconnected from the power supply 201. Since the auxiliary contacts 205 are simultaneously switched to the other side, the current flowing in the circuit as designated by the broken-line arrows is interrupted and the indicator lamps 211 and 211' are accordingly turned off. When the push-button is released, the switch 213 is returned to the operational state shown in FIG. 6 and hence a current will flow in a circuit composed of the push-button switch 213, the transformer 209, the auxiliary contacts 205, the diode 208*c*, the coil 206, the diode 208*b*, and the coil 216 (as designated by the solid-line arrows) and the electromagnetic coil 216 is thus energized. Accordingly, the keep relay 218 is operated and the switching contact 217 is switched to the other side. Although current will flow through the series-connected coils 206 and 216, because the impedance of the coil 216 is much higher than that of the coil 206, the keep relay 207 is not operated. The charge stored in the capacitor 219 given rise to a current which flows in the coil 206 when the current flowing in the circuit as designated by the solid-line arrows is switched to the current flowing in the circuit as designated by the broken-line arrows when the operation indicating circuit 210 is operated. However, the magnitude of the current flowing in the circuit as designated by the broken-line arrows is small and is insufficient to operate the keep relay 207. In this case, the function of the capacitor 219 is only to smooth the pulsating current. It is noted that although it has been described that the connection of the diodes 208*a* and 208*c* is switched by the auxiliary contacts 206, a similar operation may be conducted if the diodes 208*b* and 208*d* switched by the auxiliary contacts 205 as shown in FIG. 7 by connecting the auxiliary contacts 205 to the side P in FIG. 6. It is also noted that the main contacts 204 may be closed by the push-button switch 213 is the operation indicating circuit 210 and may also be opened by the push-button switch 213' in the operation indicating circuit 210', and vice versa in the remote control switch device constructed according to the invention.

As previously described, this embodiment of a remote control switch device of the invention employs as a main switch the keep relay and a capacitor is connected in parallel with the operating coil of the keep relay. This capacitor serves to cause current to constantly flow through the electromagnetic coil when the current is otherwise momentarily interrupted. The remote control switch device thus constructed may employ ordinary signal communication lines and is operated by merely depressing a simple push-button switch having A-type contacts to connect or disconnect the load to or from the power supply. The remote control switch device thus constructed may also employ a commercially-available operation indicating circuit using a keep relay and may include two operation indicating circuits disposed at different remote positions.

Next, a push-button switch adapted for the remote control switch device of the invention will be described with reference to FIGS. 8 through 11.

Figure 8:
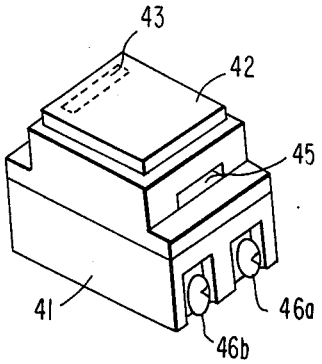
FIG. 8 is a perspective view of a first example of a push-button switch adapted for use in a remote control switch device of the invention.

In FIG. 8, there is shown a self-resetting type push-button 42 which is formed as a transparent member positined on the top of a box-like body 41 made of an insulating material. Within the push-button 42 are provided an indicating circuit 44, which will be hereinafter described in greater detail, which includes a light emitting diode 43 and a lamp connected in series with the diode 43 and contacts disposed therein. Reference numeral 45 indicates a groove formed to mount the push-button switch on a control panel or the like, and reference numerals 46a and 46b depict terminal screws mounted on the side of the body 41.

Figure 9:
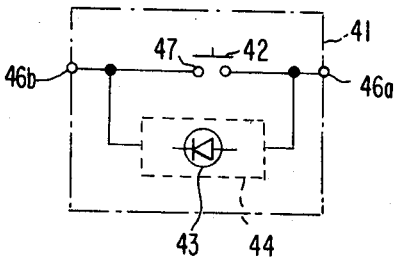
FIG. 9 is a schematic diagram of the internal configuration of the push-button switch shown in FIG. 8.

The internal wiring connection of this push-button switch is shown in FIG. 9. Both ends of the contacts 47 are connected to both ends of the indicating circuit 44 connected to the diode 43 so that a current can flow from the terminal 46a on the right side to the terminal 46b on the left side between the terminals 46a and 46b in FIG. 9. The terminal screws 46a and 46b are connected to signal communication lines connected to operate the remote control switch device of the invention. The contacts 47 are opened or closed by the push-button 42 as a result of which current flows from the terminal 46a on the right side to the terminal 46b on the left side in FIG. 9. The light produced by the light emitting diode or the lamp may be seen through the transparent push-button provided on the body 41.

Figure 10:
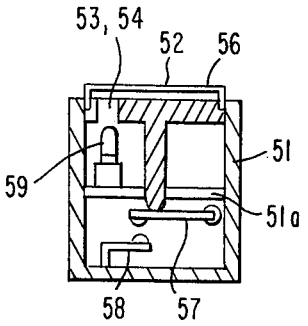
FIG. 10 is a longitudinal sectional view of a second example of the push-button switch adapted for a remote control switch device of the invention.
Figure 11:
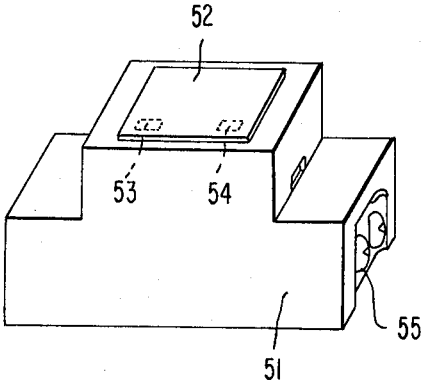
FIG. 11 is a perspective view of the push-button switch shown in FIG. 10.

Another embodiment of a push-button switch adapted for use with the remote control switch device of the invention will be described with reference to FIGS. 10 and 11. In FIG. 10, a push-button 56 is inserted in the upper opening of a case 51 with a transparent push-button cover 52 secured to the depressing portion thereof. Two indication openings 53 and 54 are formed on the depressing portion of the push button 56. The push button 56 penetrates the partition wall 51a of the case 51 with the partition wall 51a acting as a guide for the push button 56. A movable contactor 57 positioned to be depressed by the push button 56 is mounted at the side wall of the case 51. A stationary contactor 58 is secured to the bottom of the case 51 confronting the movable contactor 57. The movable contactor 57 and the stationary contactors 58 are connected through conductors (not shown) to the external terminals 55 as shown in FIG. 11. When the push-button 56 is depressed, the movable contactor 57 is urged into contact with the stationary contactor 58 to thereby close the operation circuit. Indicator lamps 59 are mounted on within the openings 53 and 54 of the push button 56 on the partition wall 51a. The indicator lamps 59 are connected through conductors (not shown) to respective ones of the external terminals. One indicator lamp will turn on in accordance with the operation or non-operation of the circuit as operated by the push-button switch.

FIG. 11 shows the external appearance of the push-button switch of this embodiment of the push-button switch. The indicating operation of the push-button switch is entirely the same as the conventional push-button switch. As is clear from FIG. 11, the openings 53 and 54 of the indicator lamps 59 are located under the push-button cover 52 and the area of the depressing portion of the push button 56 may be increased as compared with the conventional push-button switch of the same type and size so that this push-button switch may consequently be more easily operated than a conventional one. It is noted that since the cover of the openings 53 and 54 may be formed integrally with the push-button cover 52, its structure may be simplified.

It may be appreciated from the foregoing description that since in the push-button switch of the invention the light output of the lamp is visible through the openings provided in the push button, the area of the push button can be increased. Also, it is possible to integrally form the protective cover of the indicator lamps with the cover of the push-button, accordingly making the push-button switch more easily operable and simplified in construction.

What is claimed is:

1. A remote control switch device comprising:

a main switch connected in a closed loop circuit including an a-c power supply and a load;

control circuit means comprising a series circuit of auxiliary contacts interlocking with said main switch and a first diode connected to said auxiliary contacts, a second diode connected across said series circuit in a direction opposite that of said first diode, and an electromagnetic coil connected in series with said second diode for opening or closing said main switch by mechanically retaining said main switch alternately at open and closed positions for each operation of said coil;

an isolating transformer having a primary winding connected to said power supply of said closed loop circuit; and indication circuit means comprising a push-button switch remotely connected to a secondary winding of said isolating transformer remotely connected in series with said control circuit means and an indicator lamp and third diode connected in parallel with said push-button switch of said indication circuit means, said third diode and said first being connected so as to pass an electric current in the same direction.

2. The remote control switch device as claimed in claim 1, further comprising a fourth diode connected in series with said push-button switch of said indication circuit means, said fourth diode being connected in parallel with said indicator lamp of said indication circuit in a direction opposite to said third diode.

3. A remote control switch device comprising:

a main switch connected in a closed loop circuit including an a-c power supply and a load;

a single-phase bridge circuit including four diodes and an electromagnetic coil coupled to said bridge circuit for opening and closing said main switch by mechanically retaining said main switch alternately at open and closed position for each operation of said coil;

auxiliary contacts connected in one leg of said bridge circuit and mechanically coupled to operate simultaneously with said main switch;

operation indicating circuit means comprising series circuit of a fifth diode and an indicator lamp and a push-button switch connected in parallel with said series circuit; and a transformer connected having a primary winding coupled to said power supply of said closed loop circuit and having a secondary winding coupled through said operation indicating circuit means to said bridge circuit.

4. The remote control switch device as claimed in claim 3, further comprising second operation indicating circuit means, said second operation indicating circuit means comprising a second series circuit of an indicator lamp and a sixth diode, a three-contact change-over switch, and seventh and eighth diodes connected in opposite directions with respect to each other and connected to said push-button switch of said first operation indicating circuit means and connected to said three-contact change-over switch for switching the connection of said seventh and eight diodes and wherein said first-mentioned series circuit is connected in parallel with said second series circuit.

5. The remote control switch device as claimed in claim 3, further comprising a capacitor connected in parallel with said electromagnetic coil.

6. The remote control switch device as claimed in claim 5, wherein said auxiliary contacts are connected in series with one side of an input circuit of said bridge circuit.

7. The remote control switch device as claimed in claims 1, 2, 3, 4, 5 or 6, wherein said push-button switch comprises a self-resetting type push-button formed as a transparent member on the top of a box-like body, an indicating circuit provided within said body and including lighting means and contacts disposed therein, said body having formed therein a groove formed to mount said push-button switch, and terminal screws mounted on a side of said body.

8. The remote control switch device as claimed in claims 1, 2, 3, 4, 5 or 6, wherein said push-button switch comprises contacts connected to said indicating circuit and a diode coupled across said contacts of said push-button switch for unidirectionally passing current therethrough.

9. The remote control switch device as claimed in claims 1, 2, 3, 4, 5, or 6, wherein said push-button switch comprises a case; a push button inserted into an upper opening of said case; a transparent push-button cover secured to a depressing portion of said push-button, two indication openings being formed in said depressing portion of said push-button, said push-button penetrating at the end thereof a partition wall of said case, said partition wall acting as a guide for said push button; a movable contactor disposed to be depressed by said push button and mounted at a side wall of said case; and a stationary contactor secured to a bottom of said case confronting said movable contactor, said movable and stationary contactors being connected through conductors to an external terminal.

* * * * *